United States Patent [19]

Watanabe et al.

[11] Patent Number: 4,497,887

[45] Date of Patent: Feb. 5, 1985

[54] THERMAL DEVELOPMENT TYPE DIAZO COPYING MATERIAL WITH HYDROPHOBIC RESIN ENCAPSULATED COUPLER PARTICLE

[75] Inventors: Nobuyoshi Watanabe, Numazu; Tsutomu Matsuda, Sunto, both of Japan

[73] Assignee: Ricoh Compay, Ltd., Tokyo, Japan

[21] Appl. No.: 384,308

[22] Filed: Jun. 2, 1982

[30] Foreign Application Priority Data

Jun. 9, 1981 [JP] Japan ..... 56-88530

[51] Int. Cl.[3] ..... G03C 1/60; G03C 1/58

[52] U.S. Cl. ..... 430/138; 430/151; 430/158; 430/160; 430/162; 430/176; 430/179; 430/346; 430/348; 430/541; 250/316.1; 250/317.1; 428/913; 346/1.1; 346/76 PH; 346/135.1

[58] Field of Search ..... 430/138, 151, 179, 158, 430/160, 162, 176, 346, 348, 541; 250/316.1, 317.1; 428/913; 346/1.1, 76 PH, 135.1

[56] References Cited

U.S. PATENT DOCUMENTS

| | | | |
|---|---|---|---|
| 3,016,308 | 1/1962 | MaCaulay | 430/138 |
| 3,111,407 | 11/1963 | Lindquist et al. | 430/158 |
| 3,202,510 | 8/1965 | Hollmann | 430/138 |
| 3,322,556 | 5/1967 | Munder et al. | 430/138 |
| 3,469,981 | 9/1969 | Kosar | 430/151 |
| 3,493,374 | 2/1970 | Roncken et al. | 430/176 |
| 3,523,906 | 8/1970 | Vrancken et al. | 430/138 |
| 3,615,537 | 10/1971 | Jacobus et al. | 430/151 |
| 3,642,483 | 2/1972 | Kubo et al. | 430/151 |
| 4,400,456 | 8/1983 | Matsuda et al. | 430/138 |

*Primary Examiner*—Charles L. Bowers, Jr.

*Attorney, Agent, or Firm*—Flynn, Thiel, Boutell & Tanis

[57] ABSTRACT

A thermal development type diazo copying material comprising a support material and a photosensitive layer formed on the support material, which photosensitive layer comprises a diazo compound, a coupling component and a thermo-fusible auxiliary coloring agent, and which coupling component is capsulated by a hydrophobic polymeric material with a softening point ranging from 50° C. to 150° C. selected from the group consisting of hydrophobic polyester resins, hydrophobic cellulose resins, hydrophobic polyamide resins and hydrophobic polyurethane resins.

12 Claims, No Drawings

THERMAL DEVELOPMENT TYPE DIAZO COPYING MATERIAL WITH HYDROPHOBIC RESIN ENCAPSULATED COUPLER PARTICLE

BACKGROUND OF THE INVENTION

The present invention relates to a thermal development type diazo copying material.

A conventional thermal development type diazo copying material comprises a support material, such as paper or a film material, and a photosensitive layer formed on the support material, which photosensitive layer comprises a diazo compound, a coupling component and an auxiliary coloring agent.

In one conventional thermal development method, development is performed by the application of heat at temperatures ranging from 150° C. to 200° C. to a diazo copying material of the above-mentioned type which contains as an auxiliary coloring agent, for instance, urea or sodium trichloroacetate, by which heat application an alkaline material, such as ammonia gas or sodium hydroxide, is produced.

In another conventional thermal development method which is an improvement of the above-mentioned development method, development is performed by the application of heat at temperatures ranging from 90° C. to 130° C. to a diazo copying material of the same type as mentioned above, which contains as an auxiliary coloring agent a higher fatty acid amide, which is melted by the heat application and activates the diazo compound and coupling contained in the diazo copying material. An advantage of this thermal development diazo copying material is that development can be done at lower temperatures than in the case of the first described thermal development diazo copying material. However, its disadvantage is that the thermal development diazo copying material easily deteriorates before use during storage and cannot be preserved for a long period of time.

In these conventional thermal development methods, moreover, higher development temperatures are required than the development temperatures required for a dry type diazo copying material to which ammonia gases are applied from the outside for development.

Further, in the conventional thermal development methods, in the choice of diazo compounds, priority is given to heat resistance rather than to the capability of obtaining high image density. Somehow the diazo compounds which are durable at high temperature cannot yield high image density.

Still further, in the conventional thermal development methods, a heat application apparatus capable of applying heat at such high temperatures to the thermal development diazo materials, with the temperatures being accurately controlled within ±10 degrees, is required, but such heat application apparatus is costly. The temperature range of ±10 degrees is not at all large in this field. A copying machine employing such a thermal development type diazo copying material is usually used at room temperature, and the difference between the development temperatures and room temperature is so great that it is difficult to control the temperatures within the range of ±10 degrees, in particular, when a large number of copies are made continuously or when only a few copies are made at each start-up.

As a matter of course, if the development temperatures are not controlled within the above-mentioned range, development is insufficiently done or excessively done, causing discoloration.

For the above reasons, the thermal development type diazo copying materials are not popular in the field of diazo copying materials, although the thermal development type diazo copying materials have advantages in that they can provide dry copies by use of a simple development apparatus, and in that the copying machines employing the thermal development type diazo copying materials can be reduced in size in comparison with other conventional diazo copying machines.

SUMMARY OF THE INVENTION

It is therefore an object of the present invention to provide a thermal development type diazo material which is capable of providing images with high image density at comparatively low development temperatures ranging from 90° C. to 130° C. and which is excellent in preservability.

This object of the present invention is attained by a thermal development type diazo copying material which comprises a support material and a photosensitive layer formed on the support material, which photosensitive layer comprises a diazo compound, a coupling component and a thermo-fusible auxiliary coloring agent, and which coupling component is capsulated by a hydrophobic polymeric material with a softening point ranging from 50° C. to 150° C. selected from the group consisting of hydrophobic polyester resins, hydrophobic cellulose resins, hydrophobic polyamide resins and hydrophobic polyurethane resins.

The hydrophobic polyester resin are those hydrophobic resins having structural units linked by ester groups wherein the resin is formed by condensation of carboxylic acids with polyhydric alcohols.

DETAILED DESCRIPTION OF THE PREFERRED EMBODIMENTS

A thermal development type diazo copying material according to the present invention comprises a support material and a photosensitive layer formed on the support material, which photosensitive layer comprises a diazo compound, a coupling component and a thermo-fusible auxiliary coloring agent, and which coupling component is capsulated by a hydrophobic polymeric material with a softening point ranging from 50° C. to 150° C. selected from the group consisting of hydrophobic polyester resins, hydrophobic cellulose resins, hydrophobic polyamide resins and hydrophobic polyurethane resins.

Examples of diazo compounds for use in the present invention are (a) double salts of (i) metal halides, such as zinc chloride, cadmium chloride or tin chloride, and (ii) chlorides of the following diazo compounds; and (b) salts of (i) strong acids, such as sulfuric acid, fluoboric acid or hexafluorophosphoric acid, and (ii) the following diazo compounds:

4-diazo-1-dimethylaminobenzene,
4-diazo-1-dimethylaminobenzene,
4-diazo-1-dipropylaminobenzene,
4-diazo-1-methylbenzylaminobenzene,
4-diazo-1-dibenzylaminobenzene,
4-diazo-1-ethylhydroxyethylaminobenzene,
4-diazo-1-diethylamino-3-methoxybenzene,
4-diazo-1-dimethylamino-2-methylbenzene,
4-diazo-1-benzoylamino-2,5-diethoxybenzene,
4-diazo-1-morpholinobenzene,
4-diazo-1-morpholino-2,5-diethoxybenzene, 4-diazo-1-morpholino-2,5-dibutoxybenzene,
4-diazo-1-anilinobenzene,
4-diazo-1-dimethylamino-3-carboxybenzene,
4-diazo-1-tolylmercapto-2,5-diethoxybenzene, and
4-diazo-1,4-methoxybenzoylamino-2,5-diethoxybenzene Diazo compounds for use in the present invention are not limited to the above listed compounds.

Examples of coupling components for use in the present invention are as follows:
resorcinol
phloroglucinol
2,5-dimethyl-4-morpholinomethylphenol,
3-hydroxycyanoacetonailide,
para-sulfoacetanilide,
1-benzoylamino-8-hydroxynaphthalene-3,6-disulfonamide
2,3-dihydroxynaphthalene,
2,7-dihydroxynaphthalene-3,6-sodium disulfonate,
2,3-dihydroxynaphthalene-6-sodium sulfonate,
2,5-dihydroxynaphthalene-6-sodium sulfonate,
1-hydroxynaphthalene-4-sodium sulfonate,
1-amino-3-hydroxynaphthalene-3,6-disulfonamide,
Naphthol AS,
Naphthol AS-D,
2-hydroxynaphthalene-3-biguanide,
2-hydroxy-3-naphthoic acid morpholino-propylamide,
2-hydroxy-3-naphthoic acid ethanolamide,
2-hydroxy-3-naphthoic acid N-dimethylaminopropylamide hydrochloric salt
2,4,2',4'-tetrahydroxydiphenyl, and
2,4,2',4'-tetrahydroxydiphenylsulfoxide As the thermo-fusible auxiliary coloring agent for use in the present invention, any material can be employed if it is insoluble in water and fusible with a melting point in the range of 50° C. to 150° C. and capable of dissolving both the diazo compound and the coupling component when it is melted by heat application.

Examples of such thermo-fusible auxiliary coloring agents are as follows:

(1) Fatty acid amides of the general formula $$RCONH_2 \qquad \text{(A-1)},$$

where R represents an alkyl or unsaturated alkphatic hydrocarbon having 5 to 24 carbon atoms.

The following are specific examples of such fatty amides:
caproic amide,
caprylic amide,
lauric acid amide,
myristic acid amide,
palmitic acid amide,
stearic acid amide,
arachic acid amide,
behenic acid amide,
palmitoleic acid amide,
oleic amide,
eicosenoic acid amide,
erucic acid amide,
elaidic amide,
linoleic acid amide,
linoleinic acid amide, and
ricinoleic acid amide (2) N-substituted fatty acid amides of the general formula $$R^1CONHR^2 \qquad \text{(A-2) or}$$

$$R^3NHCOR^4 \qquad \text{(A-2')}$$

where $R^1$ and $R^3$ each represent an alkyl or unsaturated aliphatic hydrocarbon having 5 to 24 carbon atoms, and $R^2$ and $R^4$ each represent an alkyl having 1 to 5 carbon atoms, or a substituted or unsubstituted phenyl, or a substituted or unsubstituted cyclohexyl.

Specific examples of the N-substituted fatty acid amides represented by the general formula (A-2) are as follows:
N-methyl palmitic acid amide,
N-methyl stearic acid amide,
N-propyl stearic acid amide,
N-butyl stearic acid amide,
stearic acid anilide,
N-methyl behenic acid amide,
N-ethyl behenic acid amide,
N-butyl behenic acid amide,
behenic acid anilide,
N-methyl oleic amide,
linoleic acid anilide,
N-ethyl capric amide,
N-butyl lauric acid amide,
capric acid-o-methoxyanilide, and
N-hexylstearic acid amide Specific examples of the N-substituted fatty acid amides represented by the general formula (A-2') are as follows:
N-octadecylacetamide,
N-octadecylbutylamide,
N-octadecylpropionamide,
N-oleylacetamide,
N-oleylbenzamide,
N-laurylbutylamide,
N-laurylbenzamide,
N-behenylacetamide,
N-behenylpropionamide,
N-behenylbenzamide,
N-myristylbenzamide,
N-stearylbenzamide,
N-stearylacetamide,
N-stearylcyclohexylamide,
N-stearyl-o-chlorobenzamide,
N-palmitylbenzamide, and
N-palmitylacetamide, (3) Benzamide derivatives of the following general formula (A-3)

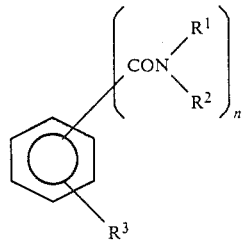

where $R^1$ and $R^2$ each represent hydrogen or an alkyl having 1 to 5 carbon atoms, $R^3$ represents hydrogen or an alkyl or alkenyl having 1 to 5 carbon atoms, and n is an integer 1 or 2.

The following are specific examples of such benzamide derivatives:
mono-benzamide,
di-benzamide, N,N-dimethyl-mono-benzamide,
N,N-dimethyl-di-benzamide,
N,N-dibutyl-mono-benzamide,
N,N-dibutyl-di-benzamide,
N,N-methyl-ethyl-mono-benzamide,
N,N-methyl-ethyl-di-benzamide,
4-methyl-mono-benzamide,
4-methyl-di-benzamide,
4-butyl-mono-benzamide, and
4-butyl-di-benzamide.

(4) N-substituted carbamate compounds of the general formula $$R^1OCONHR^2 \quad \text{(A-4)}$$

where $R^1$ and $R^2$ each represent a chain-like or cyclic alkyl, or an alkenyl having 1 to 30 carbon atoms, or an aryl or an aralkyl; all of which groups can contain further a halogen, an oxygen-containing group, such as hydroxy, carboxy, or alkoxy, a nitrogen-containing group, such as amino or nitro, and a sulfur-containing group, such as mercapto or sulfido.

The following are specific examples of such N-substituted carbamate compounds:
N-phenyl cyclobutyl carbamate,
N-phenyl decahydronaphthyl carbamate,
N-naphthyl decahydronaphthyl carbamate,
N-phenyl cyclohexyl carbamate,
N-phenyl butyl carbamate,
N-naphthyl propyl carbamate,
N-hexyl-1-phenylethyl carbamate,
N-hexyl-1-benzyl-o-ethyl carbamate,
N-naphthyl dichlorocyclopropyl carbamate,
N-naphthyl propyl carbamate,
N-phenyl-(o-propyl-tolyl) carbamate,
N-phenyl methylcyclohexyl carbamate,
N-naphthyl isobutyl carbamate,
N-phenyl xylyl carbamate,
N-naphthyl-t-butyl carbamate,
N-phenyl-1,2,3,4-tetrahydronaphthyl carbamate,
N-naphthyl-1-phenylethyl carbamate,
N-phenyl-1-bezyl-iso-propyl carbamate,
N-phenyl dimethylcyclohexyl carbamate,
N-phenyl methylcylcohexyl carbamate,
N-phenyl-3-oxo-n-butyl carbamate,
N-phenyl dimethylcyclohexyl carbamate,
N-phenyl-2-naphthylethyl carbamate,
N-phenyl tolyl carbamate,
N-phenyl(1-phenyl-iso-propyl) carbamate,
N-phenyl decenyl carbamate,
N-phenyl(1-carboxyl-iso-butyl) carbamate,
N-naphthyl propyl carbamate, and
N-phenyl heptyl carbamate.

(5) Ketone compounds of the general formula $$R^1COR^2 \quad \text{(A-5)}$$

where $R^1$ and $R^2$ each represent a chain-like or cyclic alkyl, or an alkenyl having 6 to 30 carbon atoms, or an aryl or an aralkyl; all of which groups can contain further an oxygen-containing group, such as hydroxyl, oxo, carboxyl, or alkoxy; a nitrogen-containing group, such as amino or nitro; and a sulfur-containing group, such as mercapto or sulfido.

The following are specific examples of such ketone compounds:
Didecyl ketone,
decyl undecyl ketone,
diundecyl ketone,
undecyl dodecyl ketone,
didodcyl ketone,
dodecyl tridecanyl ketone,
ditridecanyl ketone,
tridecanyl tetradecanyl ketone,
ditetradecanyl ketone,
tetradecanyl pentadecanyl ketone,
dipentadecanyl ketone,
pentadecanyl hexadecanyl ketone,
dihexadecanyl ketone,
hexadecanyl heptadecanyl ketone,
diheptadecanyl ketone,
heptadecanyl octadecanyl ketone,
dioctadecanyl ketone,
octadecanyl nonadecanyl ketone,
dinonadecanyl ketone,
cyclohexyl decycl ketone,
cyclohexyl undecyl ketone,
cyclohexyl dodecyl ketone,
cyclohexyl tridecanyl ketone,
cyclohexyl tetradecanyl ketone,
cyclohexyl pentadecanyl ketone,
cyclohexyl hexadecanyl ketone,
cyclohexyl heptadecanyl ketone,
cyclohexyl octadecanyl ketone,
cyclohexyl nonadecanyl ketone,
phenyl decyl ketone,
phenyl undecyl ketone,
phenyl dodecyl ketone,
phenyl tridecanyl ketone,
phenyl tetradecanyl ketone,
phenyl pentadecanyl ketone,
phenyl hexadecanyl ketone,
phenyl heptadecanyl ketone,
phenyl octadecanyl ketone,
phenyl nonadecanyl ketone,
benzophenone,
deoxybenzoin,
chalcone,
4,4'-di-n-propyl-benzophenone,
4,4'-di-n octyl-benzophenone,
4-n-octyl-4'-n-nonyl-benzophenone, and
4,4'-n-decyl-benzophenone.

(6) Polyalkylene glycols with a molecular weight in the range of 6,000 to 200,000, for example, polymers of alkyleneoxides (for example, ethylene oxide, propylene oxide and butylene oxide); polyethylene glycol, polyproylene gycol and copolymers thereof; and a block polymer of polyoxyethylene-oxypropylene.

(7) Urea derivatives of the general formula

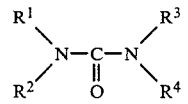

(A-7)

where $R^1$ and $R^3$ each represent an alkyl having 2 to 12 carbon atoms, or an aralkyl, or an aryl; and $R^2$ and $R^4$ each represent an alkyl having 2 to 12 carbon atoms, or an aryl.

The following are specific examples of such urea derivatives:
N,N'-diphenyl-N,N'-diethyl urea,
N,N'-diphenyl-N,N'-di-n-propyl urea,
N,N'-diphenyl-N,N'-di-iso-propyl urea,
N,N'-diphenyl-di-n-butyl urea, N,N'-diphenyl-N,N'-di-sec-butyl urea,
N,N'-diphenyl-N,N'-di-tert-butyl urea,
N,N'-diphenyl-N,N'-di-n-pentyl urea,
N,N'-diphenyl-N,N'-di-n-hexyl urea,
N,N'-diphenyl-N,N'-di-n-heptyl urea,
N,N'-diphenyl-N,N'-di-n-octyl urea,
N,N'-diphenyl-N,N'-di-n-nonyl urea,
N,N'-diphenyl-N,N'-di-n-decyl urea,
N,N'-diphenyl-N,N'-di-n-undecyl urea,
N,N'-diphenyl-N,N'-di-n-dodecyl urea,
N,N'-di(4-methylphenyl)-N,N'-di-n-propyl urea,
N,N'-di(4-ethylphenyl)-N,N'-di-n-butyl urea,
N,N'-di(4-methoxyphenyl)-N,N'-di-n-hexyl urea,
N,N'-di(4-ethoxyphenyl)-N,N'-di-n-propyl urea,
N,N'-di(4-butylphenyl)-N,N'-di-n-hexyl urea,
N,N'-di(4-hexylphenyl)-N,N'-di-n-behenyl urea,
N,N'-diaryl-N,N'-di-n-hexyl urea,
N,N'-diaryl-N,N'-di-n-octyl urea,
N,N'-diaryl-N,N'-di-n-decyl urea,
N,N'-diaryl-N,N'-di-n-dodecyl urea, and
N,N'-diphenyl-N,N'-diaryl urea.

(8) Guanidine derivatives of the general formula

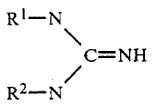

(A-8)

where $R^1$ and $R^2$ each represent an alkyl or alkenyl having 5 to 24 carbon atoms, perferably 10 to 20 carbon atoms; a substituted or unsubstituted phenyl; a substituted or unsubstituted cyclohexyl; or a substituted or unsubstituted morpholino, wherein said phenyl, cyclohexyl and morpholino can be connected to one or two lower alkyls (preferably to a methyl).

The following are specific examples of such guanidine derivatives:
1,3-N-dipentadecyl guanidine,
1,3-N-dihexadecyl guanidine,
1,3-N-diheptadecyl guanidine,
1,3-N-dioctadecyl guanidine,
1,3-N-dinonadecyl guanidine,
1,3-N-dieicosyl guanidine,
1,3-N-didodesenyl guanidine,
1,3-N-dihexadesenyl guanidine,
1,3-N-dieicosenyl guanidine,
1,3-N-diphenyl guanidine,
1,3-N-ditolyl guanidine,
1,3-N-dixylyl guanidine,
1,3-N-dicyclohexyl guanidine,
1,3-N-di(methycyclohexyl) guanidine,
1,3-N-morpholino guanidine,
1,3-N-di(methylmorpholino) guanidine, and
1,3-N-di(dimethylmorpholino) guanidine.

(9) Aroyloxy compounds of the general formula $$Ar—COO-Y)_n \quad \text{(A-9)}$$

where Ar represents an aromatic group, such as a phenyl and a naphthyl, which aromatic group may bear a substituent, such as an alkyl, an aralkyl, an alkoxy, an aryloxy, an acyl, an aroyl or halogen; and Y represents an alkyl or a phenyl, both of which may also bear a substituent, such as an alkyl, an aralkyl, an araloxy, an aryloxy, an acyl, an aroyl or halogen.

The following are specific examples of such aroyloxy compounds:

(1)

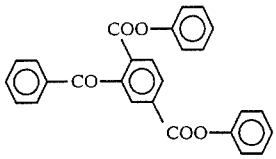

(2)

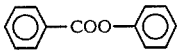

(3)

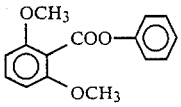

(4)

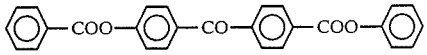

(5)

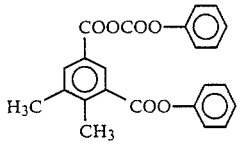

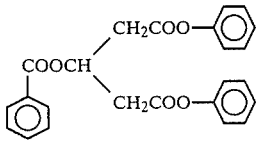

(7)

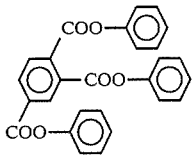

(8)

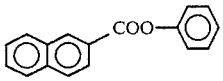

(9)

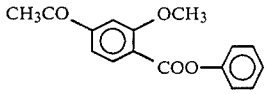

(10)

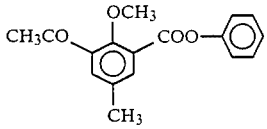

(11)

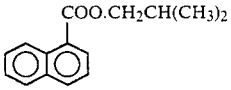

(12)

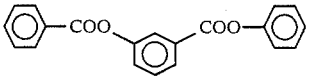

(13)

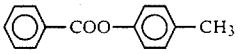

-continued

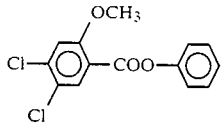

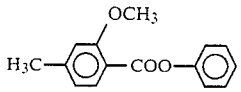

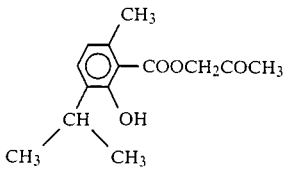

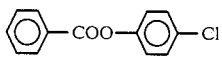

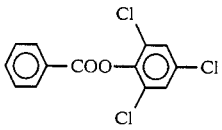

The above-described compounds, which are employed as the auxiliary coloring agent in the present invention, are thermo-fusible and only slightly soluble, or insoluble, in water. Those compounds are used in the form of particles with a particle size ranging from 0.1 μm, to 10 μm, in an amount of 0.1 to 20 parts by weight, preferably 1 to 10 parts by weight, with respect to 1 part by weight of the diazo compound.

In the present invention, the previously described coupling component is capsulated by a hydrophobic polymeric material with a softening point ranging from 50° C. to 150° C. selected from the group consisting of hydrophobic polyester resins, hydrophobic cellulose resins, hydrophobic polyamide resins, and hydrophobic polyurethane resins. The capsulating of the coupling component by those resins can be done in a conventional procedure described, for example, in U.S. Pat. No. 2,800,457 and U.S. Pat. No. 2,800,458. The appropriate size of each capsule is in the range 1 μm to 50 μm.

Examples of the hydrophobic polyester resins with a softening point ranging from 50° C. to 150° C. are the following unsaturated alkyd resins (1), polyetylene terephthalate (2), polybisphenol isophthalate (3) and polycarbonate (4):

(1) Unsaturated alkyd resins

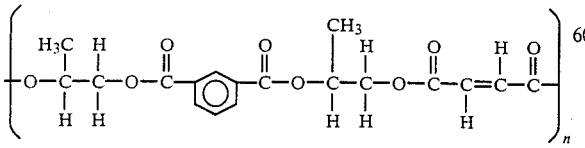

where n is an integer of 2 to 20

-continued (14)

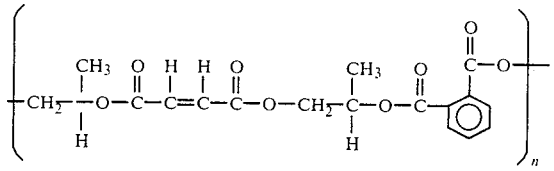

where n is an integer of 2 to 20, and (15)

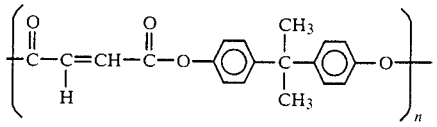

where n is an integer of 2 to 20

(16)

(2) Polyethylene terephthalate

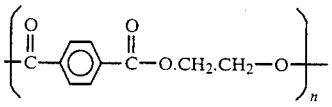

where n is an intger of 2 to 20

(17)

(3) Polybisphenol isophthalate

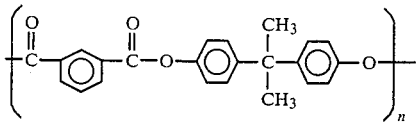

where n is an integer of 2 to 20

(18)

(4) Polycarbonate

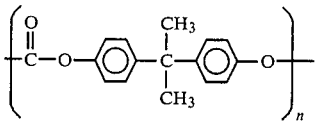

where n is an integer of 2 to 20

Examples of the hydrophobic cellulose resins with a softening point ranging from 50° C. to 150° C. are as follows:

Acetyl cellulose, cellulose acetate propionate, cellulose acetate butyrate, methyl cellulose, ethyl cellulose, hydroxyethyl cellulose, carboxymethyl cellulose, methylhydroxy-ethyl cellulose, ethylhydroxy-ethyl cellulose, methylhydroxy-propyl cellulose, and benzyl cellulose.

Examples of the hydrophobic polyamide resins with a softening point ranging from 50° C. to 150° C. are as follows:

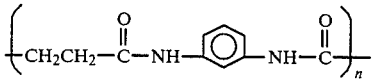

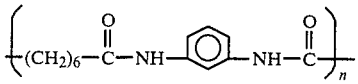

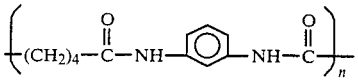

-continued

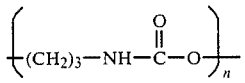

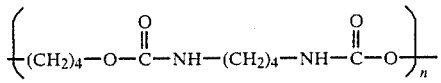

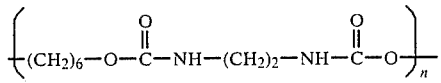

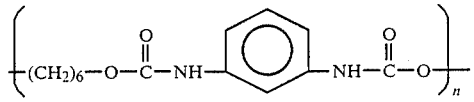

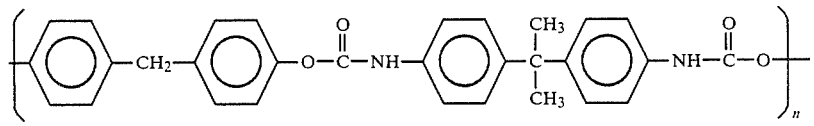

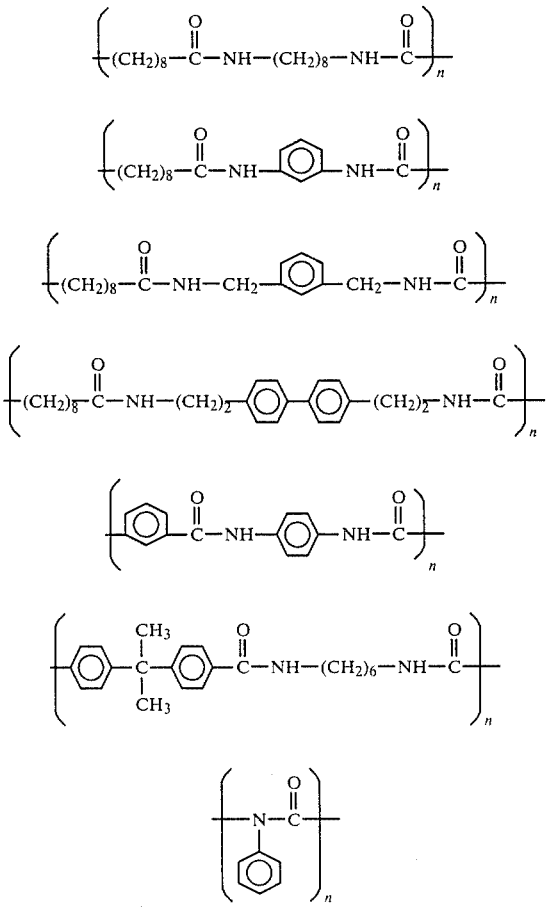

Examples of the hydrophobic urethane resins with a softening point of 50° C. to 150° C. are as follows:

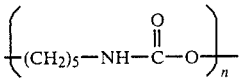

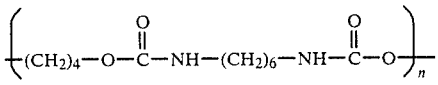

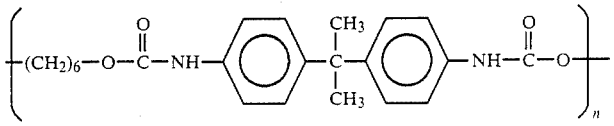

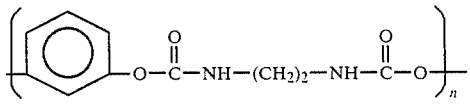

where n is an integer of 2 to 20.

In the present invention, it is preferable that the coupling component and the hydrophobic polymeric material be respectively employed in the ratio of 1:(0.5 to 10) by weight.

Further, in the present invention, in addition to the above described materials, the following additives can be employed:

(1) Alkaline-material-producing additives which produce alkaline materials upon application of heat, for example, urea, thiourea and derivatives thereof, trichloroacetate, ammonium chloride, ammonium sulfate, and ammonium citrate.

(2) Preservability-improving additives for improving the preservability of the diazo copying material according to the present invention, for example, sodium naphthalene-mono-sulfonate, sodium naphthalene-di-sulfonate, sodium naphthalene-trisulfonate, sulfosalicylic acid, cadmium sulfate, magnesium sulfate, cadmium chloride and zinc chloride.

(3) Anti-oxidation additives for preventing the oxidation of the diazo copying material according to the present invention, for example, thiourea and urea.

(4) Dissolving-acceleration additives for accelerating the mutual dissolving of the diazo compound and the coupling component, for example, caffeine and theophylline.

(5) Acid stabilizers for stabilizing the properties of the diazo copying material according to the present invention, such as citric acid, tartaric acid, sulfuric acid, oxalic acid, boric acid, phosphoric acid, and pyrophosphoric acid, each with the addition of a small amount of saponin thereto.

(6) Binder agents, such as starch, casein, polyvinyl acetate, polyvinyl alcohol, and polyacrylic acid derivatives.

(7) Image density improving additives, such as silica, starch, clay, and organic and inorganic resin particles.

The diazo copying material according to the present invention can be prepared by coating on a support material, such as a sheet of paper or a film, an aqueous dispersion of a diazo compound, a coupling component which is capsulated by one of the previously described polymeric materials, an auxiliary coloring agent and the above-described additives, under a conventional procedure, and by drying the coated dispersion, thereby forming a photosensitive layer on the support material with a deposition of 2.5 g/m$^2$ to 15 g/m$^2$ of the coated materials. The thus prepared diazo copying material is of a single-layer type.

Alternatively, the diazo copying material can be prepared as follows: An aqueous solution of an image density improving additive and a binder agent, with a capsulated coupling component dispersed therein, is first coated on the support material and is then dried, with a deposition of 2 g/m$^2$ to 10 g/m$^2$, to form a precoat layer on the support material. An aqueous solution or dispersion of a diazo compound and other additives is coated on the precoat layer and is then dried, with a deposition of 0.5 g/m$^2$ to 5 g/m$^2$. The thus prepared diazo copying material is of a double-layer type.

In both types, it is preferable that the diazo compound, the coupling component and the auxiliary coloring agent be employed in the ratio of 1:(0.1 to 10):(0.1 to 20) by weight, provided that the weight of the coupling component does not include the weight of its capsules in the above ratio.

Image formation by use of the thermal development type diazo copying material according to the present invention can be done, for example, by either of the following two methods:

The first method is the same as that employed for conventional diazo copying materials, in which first method the thermal development type diazo copying material according to the present invention is exposed to light images by use of a fluorescent or mercury lamp, and is then heated at temperatures ranging from 90° C. to 130° C. by infrared rays, a heat roller or by high-frequency induction heating.

The second method is the same as that employed for conventional thermal development type diazo copying materials, in which second method the thermal development type diazo copying material according to the present invention is heated in image patterns by a heat pen or a heat head, or exposed and heated in image patterns by infrared rays.

In both methods, thereafter, the thermal development type diazo copying material is subjected to overall exposure by a fluorescent lamp, a mercury lamp or ultraviolet rays, in order to decompose the diazo compound remaining in the non-image areas, whereby developed images can be fixed.

Embodiments of a thermal development type diazo copying material according to the present invention will now be explained by referring to the following specific examples:

EXAMPLE 1

20 g of polycarbonate (Trade name "Panlight L" manufactured by Teijin Limited) was dissolved in 200 ml of ethylene chloride. To this solution was added 10 g of Naphthol AS. The added Naphthol AS was dispersed well.

800 ml of a 1% aqueous gelatin solution was prepared and maintained at a temperature of 40° C. To capsulate the Naphthol AS, the Naphthol AS dispersion was added to the aqueous gelatin solution, with stirring by a stirrer which was rotated at 1,400 r.p.m. at 40° C. The stirring was continued for one hour at the same temperature, so that most of the ethylene chloride was eliminated by evaporation. The remainder of the ethylene chloride was eliminated under reduced pressure at room temperature, until the mixture gave off no odor of ethylene chloride. The capsulated Naphthol AS thus prepared was allowed to stand at 25° C. for 24 hours, so that the wall of each capsule was hardened. Gelatin remaining on the surface of each capsule was completely removed by washing the capsules with water at 40° C. several times and then by subjecting the capsules to dialysis at room temperature, whereby 24 g of capsulated coupler (I) containing 30 weight percent of the coupling component (i.e., Naphthol AS), with a particle size ranging from 10 μm to 30 μm, was obtained.

A mixture of the following components was dispersed by a homogenizer to prepare a precoat liquid:

| | |
|---|---|
| Capsulated coupler (I) | 6 g |
| Silica particles with a particle size ranging from 1 μm to 5 μm | 3 g |
| 10% aqueous solution of polyvinyl alcohol | 10 g |
| Stearic acid amide with a particle size ranging from 1 μm to 10 μm | 3 g |
| Water | 100 ml |

The thus prepared precoat liquid was coated on a sheet of diazo copying base paper by use of a wire bar and was then dried to form a precoat layer, with a deposition of 4 g/m$^2$.

A photosensitive liquid was prepared by mixing the following components:

| | |
|---|---|
| 4-diazo-2,5-dibutoxyphenyl morpholino chloride.$\frac{1}{2}$.$ZnCl_2$ | 1.5 g |
| Thiourea | 1.0 g |
| Isopropyl alcohol | 3 ml |
| Citric acid | 1.0 g |
| Saponin | 1.1 g |
| Water | 100 ml |

The thus prepared photosensitive liquid was coated on the precoat layer by a glass doctor and was then dried, with a deposition of 1 g/m$^2$, whereby a thermal development type diazo copying material No. 1 according to the present invention was prepared.

Comparative Example No. 1—1

For comparison, a comparative example No. 1—1 of a thermal development type diazo copying material was prepared by repeating Example 1 except that the 6 g of capsulated coupler (I) was replaced by 2 g of Naphthol AS particles with a particle size ranging from 1 μm to 10 μm.

Comparative Example No. 1-2

A comparative example No. 1-2 of a thermal development type diazo copying material was prepared by repeating Example 1 except that the stearic acid amide was removed from the precoat liquid.

An original was superimposed on each of the above thermal development type diazo copying materials and was then exposed to ultraviolet rays. Each thermal development type diazo copying material was heated at 110° C. for 3 seconds by an infrared heater, whereby blue images were formed. The image densities were measured by a Macbeth densitometer.

In order to check the preservability of each diazo copying material before use, each diazo copying material was placed in a desiccator for 24 hours, with the temperature maintained at 50° C. and the humidity at 50% RH, so that each copying material was caused to deteriorate. Each copying material was then subjected to overall exposure by a fluorescent lamp, so that the diazo compound contained in the photosensitive layer was decomposed. Thereafter, the background density of each copying material was measured by the Macbeth densitometer and compared with the background density of samples which were not subjected to the above-described deterioration.

The results of these tests are summarized in the following Table 1:

TABLE 1

| | Tested Items | | |
|---|---|---|---|
| | | Background Density | |
| Sample | Image Density | Not Deteriorated | Deteriorated |
| Example No. 1 | 1.21 | 0.12 | 0.15 |
| Comp. No. 1-1 | 1.24 | 0.12 | 0.46 |
| Comp. No. 1-2 | 0.81 | 0.10 | 0.33 |

Note:
The image densities and background densities were measured by a Macbeth densitometer.

As can be seen from the results shown in Table 1, the thermal development type diazo copying material No. 1 according to the present invention was better in image density and preservability than the comparative examples Nos. 1—1 and 1-2.

EXAMPLE 2

15 g of an unsaturated polyester resin, which is a condensation product of Bisphenol A and fumaric acid, was dissolved in 100 ml of benzene. In this solution was dispersed 5 g of Naphthol AS-D. This dispersion was added to a 10% aqueous solution of polyvinyl alcohol heated at 50° C. to 55° C. and the mixture was emulsified by vigorous stirring. Benzene was completely removed from the mixture by evaporation, under reduced pressure and with continued vigorous stirring. The thus formed capsules were filtered off, washed with water, and dried in vacuo, whereby 16 g of capsulated coupler (II) containing 25 weight percent of the coupling component (i.e., Naphthol AS-D), with a particle size ranging from 10 μm to 30 μm, was obtained.

In the above procedure, when benzene was removed completely under reduced pressure, under application of heat to the mixture at temperatures ranging from 50° C. to 60° C., a dispersion of capsulated coupler in an aqueous solution of polyvinyl alcohol, was obtained. This dispersion could have been employed as a precoat liquid in the next step.

A precoat liquid was prepared by dispersing the following components by use of a homogenizer.

| | |
|---|---|
| Capsulated coupler (II) | 8 g |
| Silica particles with a particle size ranging from 1 μm to 5 μm | 3 g |
| 10% aqueous solution of polyvinyl alcohol | 10 g |
| Stearic acid anilide with a particle size ranging from 1 μm to 10 μm | 3 g |
| Water | 100 ml |

The thus prepared precoat liquid was coated on a sheet of diazo copying base paper by use of a wire bar and was then dried to form a precoat layer, with a deposition of 4 g/m$^2$.

A photosensitive liquid was prepared by mixing the following components:

| | |
|---|---|
| 4-diazo-1-toluylmercapto-2,5-diethoxybenzene chloride.$\frac{1}{2}$.$ZnCl_2$ | 1.5 g |
| Thiourea | 1.0 g |
| Isopropyl alcohol | 3 ml |
| Citric acid | 1.0 g |
| Saponin | 1.1 g |
| Water | 100 ml |

The thus prepared photosensitive liquid was coated on the precoat layer by a glass doctor and was then dried, with a deposition of 1 g/m$^2$, whereby a thermal development type diazo copying material No. 2 according to the present invention was prepared.

Comparative Example No. 2-1

For comparison, a comparative example No. 2-1 of a thermal development type diazo copying material was prepared by repeating Example 2 except that the 8 g of capsulated coupler (II) in the precoat liquid was replaced by 2 g of Naphthol AS particles with a particle size ranging from 1 μm to 10 μm.

Comparative Example No. 2—2

A comparative example No. 2—2 of a thermal development type diazo copying material was prepared by repeating Example 2 except that the stearic acid anilide was removed from the precoat liquid.

An original was superimposed on each of the above thermal development type diazo copying materials and was exposed to ultraviolet rays. Each thermal development type diazo copying material was then heated at 110° C. for 3 seconds by an infrared heater, whereby blue images were formed.

In order to check the preservability of each diazo copying material before use, each diazo copying material was placed in a desiccator with the temperature being 50° C. and the humidity being 50%RH, for 24 hours, so that each copying material was caused to deteriorate. Each copying material was then subjected to overall exposure by a fluorescent lamp, so that the diazo compound contained in the photosensitive layer was decomposed. Thereafter, the background density of each copying material was measured by a Macbeth densitometer and compared with the background density of samples which were not subjected to the above-described deterioration.

The results of these tests are summarized in the following table 2:

TABLE 2

| | Tested Items | | |
|---|---|---|---|
| | | Background Density | |
| Sample | Image Density | Not Deteriorated | Deteriorated |
| Example No. 2 | 1.28 | 0.13 | 0.21 |
| Comp. No. 2-1 | 1.32 | 0.14 | 0.72 |

TABLE 2-continued

| Sample | Tested Items | | |
|---|---|---|---|
| | Image Density | Background Density | |
| | | Not Deteriorated | Deteriorated |
| Comp. No. 2-2 | 0.98 | 0.12 | 0.54 |

Note:
The image densities and background densities were measured by a Macbeth densitometer.

As can be seen from the results shown in Table 2, the thermal development type diazo copying material No. 2 according to the present invention was better in image density and preservability than the comparative examples Nos. 2-1 and 2—2.

Example 3

20 g of an unsaturated polyester resin prepared by condensation of isophthalic acid, fumaric acid and propylene glycol was dissolved in 100 ml of cyclohexane. In this solution was dispersed 10 g of phloroglucinol. This dispersion was added to 200 ml of a 10% aqueous solution of polyvinyl alcohol and the mixture was emulsified by vigorous stirring. Cyclohexane was completely removed from the mixture by evaporation, under reduced pressure, with continued vigorous stirring and with the temperature maintained not higher than 50° C. After complete elimination of cyclohexane, the formed capsules were filtered off, washed with water, and dried in vacuo, whereby 14.2 g of capsulated coupler (III) containing 30 weight percent of the coupling component (i.e., phloroglucinol), with a particle size ranging from 10 μm to 30 μm, was obtained.

A photosensitive liquid was prepared by dispersing the following components by use of a homogenizer.

| | |
|---|---|
| Capsulated coupler (III) | 6.0 g |
| Thiourea | 2.0 g |
| Sulfuric acid | 0.2 g |
| Gelatin | 1.0 g |
| Polystyrene powder with a particle size ranging from 1 μm to 5 μm | 10.0 g |
| Stearylbenzamide | 5.0 g |
| 4-diazo-(4'-toluylbenzoylamino)-2,5-dipropoxybenzene bisulfate | 1.6 g |
| Saponin | 0.1 g |
| Water | 100 ml |

The thus prepared photosensitive liquid was coated on a sheet of diazo copy base paper, with a deposition of 3 g/m$^2$, whereby a thermal development type diazo copying material No. 3 according to the present invention was prepared.

An original was superimposed on the above thermal development type diazo copying material and was then exposed to infrared rays and heated at 110° C. for 3 seconds by an infrared heater. As a result, black images with an image density of 1.31 were formed.

The preservability of the thermal development type diazo copying material No. 3 was as excellent as that of the thermal development type diazo copying material No. 2.

Example 4

14 g of cellulose acetate butyrate was dissolved in 100 ml of butyl acetate. In this solution was dispersed 5 g of Naphthol AS-D. This dispersion was added to a 10% aqueous solution of polyvinyl alcohol heated at 50° C. to 55° C. and the mixture was emulsified by vigorous stirring. Butyl acetate was completely removed from the mixture by evaporation, under reduced pressure and with continued vigorous stirring. The thus formed capsules were filtered off, washed with water, and dried in vacuo, whereby 13 g of capsulated coupler (IV) containing 25 weight percent of the coupling component (i.e., Naphthanol AS-D), with a particle size ranging from 10 μm to 30 μm, was obtained.

A precoat liquid was prepared by dispersing the following components by use of a homogenizer.

| | |
|---|---|
| Capsulated coupler (IV) | 8 g |
| Silica particles with a particle size ranging from 1 μm to 5 μm | 3 g |
| 10% aqueous solution of polyvinyl alcohol | 10 g |
| Stearic acid anilide with a particle size ranging from 1 μm to 10 μm | 3 g |
| Water | 100 ml |

The thus prepared precoat liquid was coated on a sheet of diazo copying base paper by use of a wire bar and was then dried to form a precoat layer, with a deposition of 4 g/m$^2$.

A photosensitive liquid was prepared by mixing the following components:

| | |
|---|---|
| 4-diazo-1-toluylmercapto-2,5-diethoxybenzene chloride.$\frac{1}{2}$.$ZnCl_2$ | 1.5 g |
| Thiourea | 1.0 g |
| Isopropyl alcohol | 3 ml |
| Citric acid | 1.0 g |
| Saponin | 1.1 g |
| Water | 100 ml |

The thus prepared photosensitive liquid was coated on the precoat layer by a glass doctor and was then dried, with a deposition of 1 g/m$^2$, whereby a thermal development type diazo copying material No. 4 according to the present invention was prepared.

Comparative Example No. 4-1

A comparative example No. 4-1 of a thermal development type diazo copying material was prepared by repeating Example 4 except that the 8 g of capsulated coupler (IV) was replaced by 2 g of Naphthol AS particles with a particle size ranging from 1 μm to 10 μm.

Comparative Example No. 4-2

A comparative example No. 4-2 of a thermal development type diazo copying material was prepared by repeating Example 4 except that the stearic acid anilide was removed from the precoat liquid.

The thus prepared thermal development type diazo copying materials were subjected to the same image density tests and preservability tests as in Example 1.

The results of these tests are summarized in the following table 3:

TABLE 3

| Sample | Tested Items | | |
|---|---|---|---|
| | Image Density | Background Density | |
| | | Not Deteriorated | Deteriorated |
| Example No. 4 | 1.31 | 0.13 | 0.29 |
| Comp. No. 4-1 | 1.34 | 0.14 | 0.73 |

TABLE 3-continued

| Sample | Tested Items | | |
|---|---|---|---|
| | Image Density | Background Density | |
| | | Not Deteriorated | Deteriorated |
| Comp. No. 4-2 | 0.98 | 0.12 | 0.56 |

Note:
The image densities and background densities were measured by a Macbeth densitometer.

As can be seen from the results shown in Table 3, the thermal development type diazo copying material No. 4 according to the present invention was better in image density and preservability than the comparative examples Nos. 4–1 and 4–2.

Example 5

Example 1 was repeated except that the polycarbonate was replaced by ethyl cellulose, whereby a thermal development type diazo copying material No. 5 was prepared.

Comparative Example No. 5–1

A comparative example No. 5–1 of a thermal development type diazo copying material was prepared by repeating Example 5 except that the 6 g of capsulated coupler (I) was replaced by 2 g of Naphthol AS particles with a particle size ranging from 1 μm to 10 μm.

Comparative Example No. 5–2

A comparative example No. 5–2 of a thermal development type diazo copying material was prepared by repeating Example 5 except that the stearic acid anilide was removed from the precoat liquid.

The thus prepared thermal development type diazo copying materials were subjected to the same image density tests and preservability tests as in Example 1. The results are shown in the following table 4:

TABLE 4

| Sample | Tested Items | | |
|---|---|---|---|
| | Image Density | Background Density | |
| | | Not Deteriorated | Deteriorated |
| Example No. 5 | 1.18 | 0.12 | 0.17 |
| Comp. No. 5-1 | 1.21 | 0.12 | 0.47 |
| Comp. No. 5-2 | 0.79 | 0.11 | 0.38 |

Note:
The image densities and background densities were measured by a Macbeth densitometer.

As can be seen from the results shown in Table 4, the thermal development type diazo copying material No. 5 according to the present invention was better in image density and preservability than the comparative examples Nos. 5–1 and 5–2.

Example 6

Example 3 was repeated except that the unsaturated polyester resin was replaced by cellulose acetate propionate, and the cyclohexane employed as the solvent for the unsaturated polyester resin was replaced by ethyl acetate, whereby a thermal development type diazo copying material No. 6 according to the present invention was prepared.

Image development was performed in the same manner as in Example 3. As a result, black images with an image density of 1.28 were obtained.

The preservability of this diazo copying material was as excellent as that of the thermal development type diazo copying material No. 4.

Example 7

Example 2 was repeated except that the unsaturated polyester resin was replaced by a polyamide resin (Nylon 11), whereby a thermal development type diazo copying material No. 7 was prepared.

Comparative Example 7–1

A Comparative Example No. 7–1 of a thermal development type diazo copying material was prepared by repeating Example 7 except that the 8 g of capsulated coupler (II) in the precoat liquid was replaced by 2 g of Naphthol AS particles with a particle size ranging from 1 μm to 10 μm.

Comparative Example No. 7–2

A Comparative Example No. 7–2 of a thermal development type diazo copying material was prepared by repeating Example 7 except that the stearic acid anilide was removed from the precoat liquid.

The thus prepared thermal development type diazo copying materials were subjected to the same image density tests and preservability tests as in Example 2.

The results of these tests are summarized in the following table 5:

TABLE 5

| Sample | Tested Items | | |
|---|---|---|---|
| | Image Density | Background Density | |
| | | Not Deteriorated | Deteriorated |
| Example No. 7 | 1.26 | 0.13 | 0.27 |
| Comp. No. 7-1 | 1.33 | 0.14 | 0.73 |
| Comp. No. 7-2 | 0.96 | 0.12 | 0.51 |

Note:
The image densities and background densities were measured by a Macbeth densitometer.

As can be seen from the results shown in Table 5, the thermal development type diazo copying material No. 7 according to the present invention was better in image density and preservability than the comparative examples Nos. 7–1 and 7–2.

EXAMPLE 8

Example 1 was repeated except that the polycarbonate was replaced by a thermoplastic polyurethane with a molecular weight ranging from 500 to 600, and the methylene chloride was replaced by methyl ethyl ketone, whereby a thermal development type diazo copying material No. 8 was prepared.

Comparative Example No. 8–1

A Comparative Example No. 8–1 of a thermal development type diazo copying material was prepared by repeating Example 8 except that the 8 g of capsulated coupler (II) was replaced by 2 g of Naphthol AS particles with a particle size ranging from 1 μm to 10 μm.

Comparative Example No. 8–2

A Comparative Example No. 8–2 of a thermal development type diazo copying material was prepared by repeating Example 8 except that the stearic acid anilide was removed from the precoat liquid.

The thus prepared thermal development type diazo copying materials were subjected to the same image density tests and preservability tests as in Example 1. The results are shown in the following table 6:

TABLE 6

| Sample | Tested Items | | |
|---|---|---|---|
| | Image Density | Background Density | |
| | | Not Deteriorated | Deteriorated |
| Example No. 8 | 1.20 | 0.12 | 0.24 |
| Comp. No. 8-1 | 1.24 | 0.12 | 0.48 |
| Comp. No. 8-2 | 0.80 | 0.10 | 0.38 |

Note:
The image densities and background densities were measured by a Macbeth densitometer.

As can be seen from the results shown in Table 6, the thermal development type diazo copying material No. 8 according to the present invention was better in image density and preservability than the comparative examples Nos. 8-1 and 8-2.

Example 9

Example 3 was repeated except that the unsaturated polyester resin was replaced by 20 g of an unsaturated polyamide (Nylon 12), whereby a thermal development type diazo copying material No. 9 according to the present invention was prepared.

Image development was performed in the same manner as in Example 3. As a result, black images with an image density of 1.30 were obtained.

The preservability of this diazo copying material was as excellent as that of the thermal development type diazo copying material No. 7.

What is claimed is:

1. A thermally developable diazotype copying material comprising a support material and a photosensitive layer formed on said support material, said photosensitive layer consisting essentially of a diazonium compound suitable for use in a two component diazotype copying material, an azo coupling component and a thermo-fusible auxiliary coloring agent wherein said auxiliary coloring agent is at least one member selected from the group consisting of fatty acid amides having the formula $RCONH_2$ wherein R is a saturated or unsaturated aliphatic hydrocarbon group having 5 to 24 carbon atoms, and N-substituted fatty acid amides having the formulas $R^1CONHR^2$ and $R^3NHCOR^4$ wherein $R^1$ and $R^3$ each is a saturated or unsaturated aliphatic hydrocarbon group having 5 to 24 carbon atoms, and $R^2$ and $R^4$ each is alkyl having 1 to 5 carbon atoms, phenyl, substituted phenyl, cyclohexyl or substituted cyclohexyl, and wherein said coupling component is in the form of coupler particles encapsulated with a hydrophobic polymeric material to form capsules, said polymeric material having a softening point in the range of from 50° to 150° C. and being selected from the group consisting of hydrophobic polyester resins, hydrophobic cellulose resins, hydrophobic polyamide resins and hydrophobic polyurethane resins.

2. A copying material as claimed in claim 1 in which said hydrophobic polymeric material consists of a hydrophobic polyester resin.

3. A copying material as claimed in claim 1 in which said hydrophobic polymeric material consists of a hydrophobic cellulose resin.

4. A copying material as claimed in claim 3, wherein said hydrophobic cellulose resin is a resin selected from the group consisting of acetyl cellulose, cellulose acetate propionate, cellulose acetate butyrate, methyl cellulose, ethyl cellulose, hydroxyethyl cellulose, carboxymethyl cellulose, methylhydroxy-ethyl cellulose, ethylhydroxy-ethyl cellulose, methylhydroxy-propyl cellulose, and benzyl cellulose.

5. A copying material as claimed in claim 1, wherein said thermo-fusible auxiliary coloring agent is employed in the form of particles with a particle size ranging from 0.1 μm to 10 μm, in an amount of 0.1 to 20 parts by weight, with respect to 1 part by weight of said diazonium compound.

6. A copying material as claimed in claim 1, wherein said coupling component and said hydrophobic polymeric material are respectively contained in the ratio of 1: (0.5 to 10) by weight.

7. A copying material as claimed in claim 1, wherein said diazonium compound and said coupling component and said auxiliary coloring agent are contained in the ratio of 1: (0.1 to 10) : (0.1 to 20) by weight.

8. A copying material as claimed in claim 1, in which said thermo-fusible auxiliary coloring agent is selected from the group consisting of (1) fatty acid amides having the formula $RCONH_2$, wherein R is alkyl having 5 to 24 carbon atoms or ethylenically unsaturated aliphatic hydrocarbon having 5 to 24 carbon atoms, (2) N-substituted fatty acid amides having the formula $R^1CONHR^2$, wherein $R^1$ is alkyl having 5 to 24 carbon atoms or ethylenically unsaturated aliphatic hydrocarbon having 5 to 24 carbon atoms and $R_2$ is alkyl having 1 to 5 carbon atoms, phenyl or cyclohexyl, and (3) $R^3NHCOR^4$, wherein $R^3$ is alkyl having 5 to 24 carbon atoms or ethylenically unsaturated aliphatic hydrocarbon having 5 to 24 carbon atoms and $R_4$ is alkyl having 1 to 5 carbon atoms, phenyl or cyclohexyl.

9. A copying material as claimed in claim 1, in which said thermo-fusible auxiliary coloring agent is selected from the group consisting of (1) fatty acid amides having the formula $RCONH_2$, wherein R is alkyl having 5 to 24 carbon atoms or ethylenically unsaturated aliphatic hydrocarbon having 5 to 24 carbon atoms, and (2) N-substituted fatty acid amides having the formula $R^1CONHR^2$, wherein $R^1$ is alkyl having 5 to 24 carbon atoms or ethylenically unsaturated aliphatic hydrocarbon having 5 to 24 carbon atoms and $R_2$ is alkyl having 1 to 5 carbon atoms, phenyl or cyclohexyl.

10. A copying material as claimed in claim 1 in which said hydrophobic polymeric material consists of a hydrophobic polyamide resin.

11. A copying material as claimed in claim 1 in which said hydrophobic polymeric material consists of a hydrophobic polyurethane resin.

12. A thermally developable diazotype copying material comprising a support material and a photosensitive layer formed on said support material, said photosensitive layer consisting essentially of a diazonium compound suitable for use in a two component diazotype copying material, an azo coupling component and a thermo-fusible auxiliary coloring agent wherein said auxiliary coloring agent is at least one member selected from the group consisting of fatty acid amides having the formula $RCONH_2$ wherein R is a saturated or unsaturated aliphatic hydrocarbon group having 5 to 24 carbon atoms, and N-substituted fatty acid amides having the formulas $R^1CONHR^2$ and $R^3NHCOR^4$ wherein $R^1$ and $R^3$ each is a saturated or unsaturated aliphatic hydrocarbon group having 5 to 24 carbon atoms, and $R^2$ and $R^4$ each is alkyl having 1 to 5 carbon atoms, phenyl, substituted phenyl, cyclohexyl or substituted cyclohexyl, and wherein said coupling component is in the form of coupler particles encapsulated with a hydrophobic polymeric material to form capsules, said polymeric material having a softening point in the range of from 50° to 150° C. and being a hydrophobic resin selected from the group consisting of unsaturated alkyd resins, polyethylene terephthalate, polybisphenol, isophthalate, polycarbanate, hydrophobic cellulose resins, hydrophobic polyamide resins and hydrophobic polyurethane resins.

* * * * *